US006684803B1

(12) United States Patent
Dickson

(10) Patent No.: US 6,684,803 B1
(45) Date of Patent: Feb. 3, 2004

(54) WATERCRAFT STEERING APPARATUS WITH JOYSTICK

(75) Inventor: Trevor Alan Dickson, Dunedin (NZ)

(73) Assignee: Ceevee North America, LLC, Mt. Pleasant, SC (US)

( * ) Notice: Subject to any disclaimer, the term of this patent is extended or adjusted under 35 U.S.C. 154(b) by 0 days.

(21) Appl. No.: 10/304,179

(22) Filed: Nov. 26, 2002

(51) Int. Cl.[7] ..... B63H 25/00; B63H 20/08

(52) U.S. Cl. ..... 114/144 R; 440/62

(58) Field of Search ..... 114/144 R, 153, 114/154, 160; 440/53, 62

(56) References Cited

U.S. PATENT DOCUMENTS

| | | | | | |
|---|---|---|---|---|---|
| 1,403,318 | A | * | 1/1922 | Hansen | 114/144 R |
| 1,860,173 | A | | 5/1932 | Colstad | |
| 2,402,724 | A | * | 6/1946 | Bidwell | 114/144 R |
| 3,040,697 | A | * | 6/1962 | Federico et al. | 440/62 |
| 3,085,447 | A | * | 4/1963 | Shay | 114/144 R |
| 3,111,105 | A | | 11/1963 | Bentkowsky et al. | |
| 3,350,956 | A | | 11/1967 | Monge | |
| 3,386,308 | A | | 6/1968 | Butler | |
| 3,561,280 | A | | 2/1971 | MacPhee et al. | |
| 3,701,288 | A | | 10/1972 | Jordan | |
| 3,854,380 | A | | 12/1974 | Casey | |
| 4,173,937 | A | | 11/1979 | Kulischenko et al. | |
| 4,327,658 | A | | 5/1982 | Kulischenko | |
| 4,414,438 | A | | 11/1983 | Maier et al. | |
| 4,417,879 | A | | 11/1983 | Kulischenko | |
| 4,519,335 | A | | 5/1985 | Krautkremer et al. | |
| 4,691,659 | A | | 9/1987 | Ito et al. | |
| 4,942,838 | A | * | 7/1990 | Boyer et al. | 114/345 |
| 4,962,717 | A | | 10/1990 | Tsumiyama | |
| 5,129,846 | A | | 7/1992 | Dimijian | |
| 5,375,551 | A | * | 12/1994 | Lunter et al. | 114/145 R |
| 6,230,642 | B1 | | 5/2001 | McKenney et al. | |

* cited by examiner

*Primary Examiner*—S. Joseph Morano
*Assistant Examiner*—Andrew Wright
(74) *Attorney, Agent, or Firm*—Harleston Law Firm LLC; Kathleen M. Harleston

(57) ABSTRACT

A steering apparatus for a motor-driven watercraft includes: (a) a movable, two-directional joystick including a steering arm (b) a depressible throttle trigger affixed to an upper end portion of the joystick; and (c) a pulley system including a steering cable attached to a lower end of the steering arm, the steering cable extending around pulleys affixed to the starboard or port side of the watercraft in matching pairs; a front, matching pair of the pulleys being pivotably affixed to a hull of the watercraft on either side of the joystick, a rear pair of the pulleys being affixed to the hull of the watercraft on either side of the motor; wherein depression of the throttle trigger and relatively simultaneous movement of the joystick in a first direction, or in a second, opposite direction causes the watercraft to turn in the direction of the movement.

15 Claims, 4 Drawing Sheets

WATERCRAFT STEERING APPARATUS WITH JOYSTICK

BACKGROUND OF THE INVENTION

1. Technical Field

The present invention relates generally to a steering apparatus for a watercraft, more particularly, a pulley system for steering a small watercraft using a joystick with a throttle trigger affixed to it.

2. Background Information

Rotary steering systems of a known type used in watercraft, for example leisure-type powerboats, typically have a steering column that extends between a steering wheel and a cable housing. Within the cable housing, rotation of the steering column is translated to a push-pull movement of a cable that extends from the housing. The cable extends out of the housing and is routed to a rudder, outboard motor, or inboard/outboard stern drive. The push/pull movement of the cable acts to pivot the outboard motor, stern drive, or rudder in the desired direction to steer the watercraft.

Rotary steering systems typically have a completely enclosed cable housing, which cannot be readily opened to service the cable. The cable is not visible in such systems, so it cannot readily be checked for wear. Also, when a cable needs to be replaced, it is not possible to access the end of the cable that enters into the housing. A need therefore exists for a cable steering system that is readily serviceable.

Outboard motors of a variety of different types and horsepower ratings are commonly used on watercraft. Often, outboard motors of low to medium horsepower rating are provided with a tiller handle, which can be used to steer the motor by rotating a movable portion of the outboard motor relative to a stationary portion. The stationary portion is attached to the transom of the watercraft.

Where higher performance or higher horsepower ratings are required, a cable-operated system with a steering wheel, as described hereinabove, is typically used. Like a steering wheel in an automobile, the steering wheel of a watercraft is popular because its use is generally intuitive.

Although steering wheel devices are popular, such systems rely on converting rotational movement to linear movement. For example, a rudder or outboard motor often requires application of a linear force and linear movement to effect steering. Devices for achieving this may be, for example, a rack and pinion drive. One of the disadvantages of having to convert rotary motion into linear motion is that the apparatus generally required for this purpose is relatively expensive to manufacture. For example. worm gear drives or rack and pinion drives require many high tolerance machined components.

Other disadvantages relate to the steering rate, that is, the amount of rotation of the output device (e.g., outboard motor) for a given number of degrees of rotation of the input device, for example, the steering wheel. A steering apparatus using a worm drive may require several revolutions of the steering wheel to provide a relatively short output movement, thus making it unsuitable for high performance applications requiring fast steering response.

Another disadvantage of the prior art steering apparatus relates to its size and weight. Such systems are generally too heavy and bulky to be useful in, for example, a small personal watercraft.

The present invention provides a watercraft steering apparatus with a joystick and a pulley system, which overcomes some or all of the problems and shortcomings of currently available steering apparatus, or at least provides the public with a useful choice. The steering apparatus of the present invention is relatively small in size, light in weight, and relatively easy to manufacture. It is also very easy to adjust and repair. With this simple steering apparatus, which is not hydraulic and does not require electricity, a small one or two person watercraft is very responsive to the commands of the driver.

BRIEF SUMMARY OF THE INVENTION

The present invention is a watercraft steering apparatus for a motor-driven watercraft, comprising:

(a) a movable, two-directional joystick in an aft portion of the watercraft, the joystick being comprised of a steering arm with a hand grip on its upper end portion;

(b) a depressible throttle trigger affixed to an upper end portion of the joystick; and (c) a pulley system comprising a steering cable, opposite ends of the steering cable being attached to a lower end of the steering arm, the steering cable extending around a plurality of pulleys affixed to the starboard or port side of the watercraft in matching pairs; a front, matching pair of the plurality of pulleys being pivotably affixed to a hull of the watercraft on either side of the joystick, a rear pair of the plurality of pulleys being affixed to the hull of the watercraft on either side of the motor, which is movably attached to a stem of the watercraft;

wherein depression of the throttle trigger and relatively simultaneous movement of the joystick in a first direction, or in a second direction opposite to the first direction, causes the motor to move a corresponding incremental amount, which causes the watercraft to turn in the direction of the movement.

The steering apparatus of the present invention is quite easy for a layman to operate, since he or she need only squeeze the throttle trigger to the hand grip and move two-directional joystick right or left. Having a throttle trigger adjacent to a hand grip of the joystick allows for one-handed operation of the watercraft. There is no need to rotate a steering wheel. The steering apparatus of the present invention is relatively safe, since it idles when the throttle trigger is released. The watercraft turns according to the amount the joystick has been moved.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
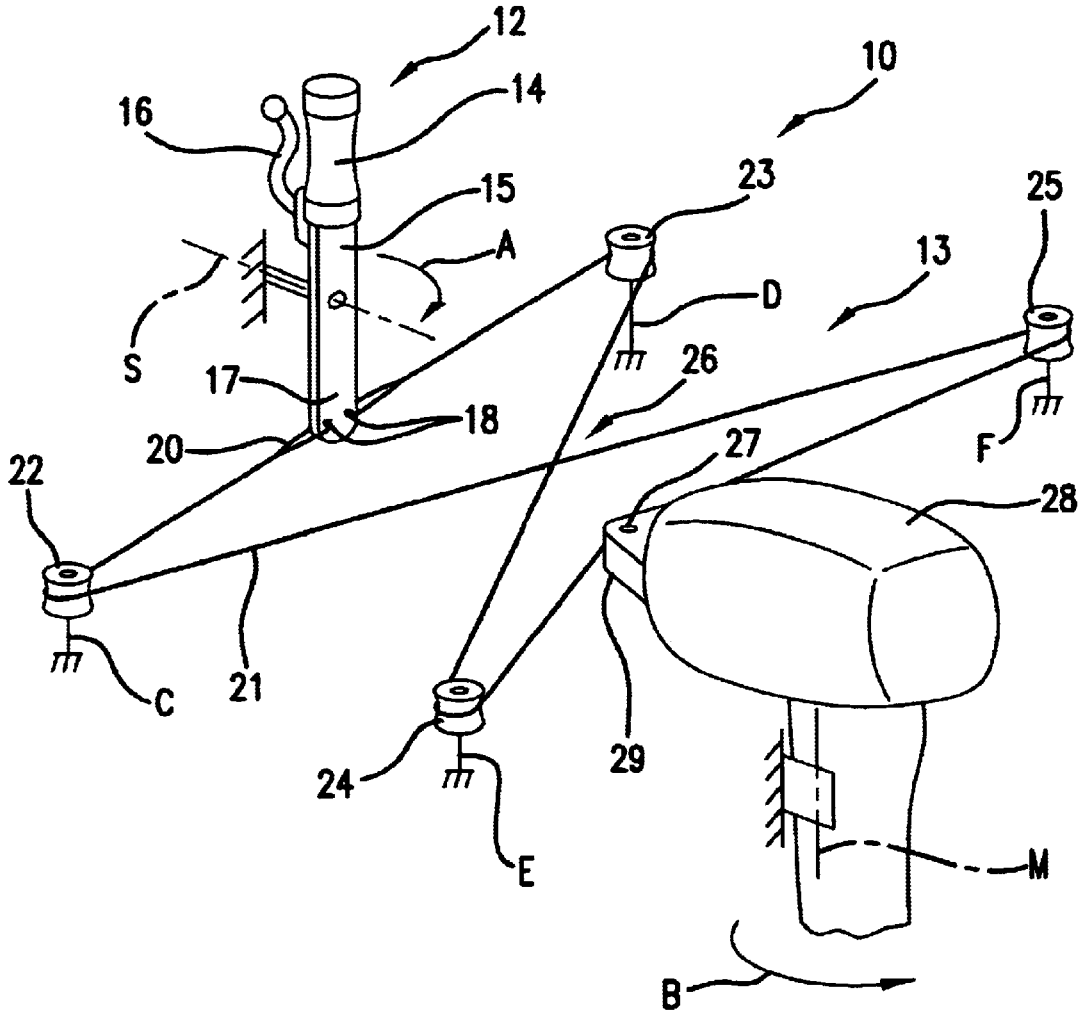
FIG. 1 is a perspective view of a watercraft steering apparatus according to the present invention.

In the following description, like reference characters designate like or corresponding parts throughout the several views. Also, in the following description, it is to be understood that such terms as "front," "rear," "within," and the like are words of convenience and are not to be construed as limiting terms. Referring in more detail to the drawings, the invention will now be described.

Figure 2:
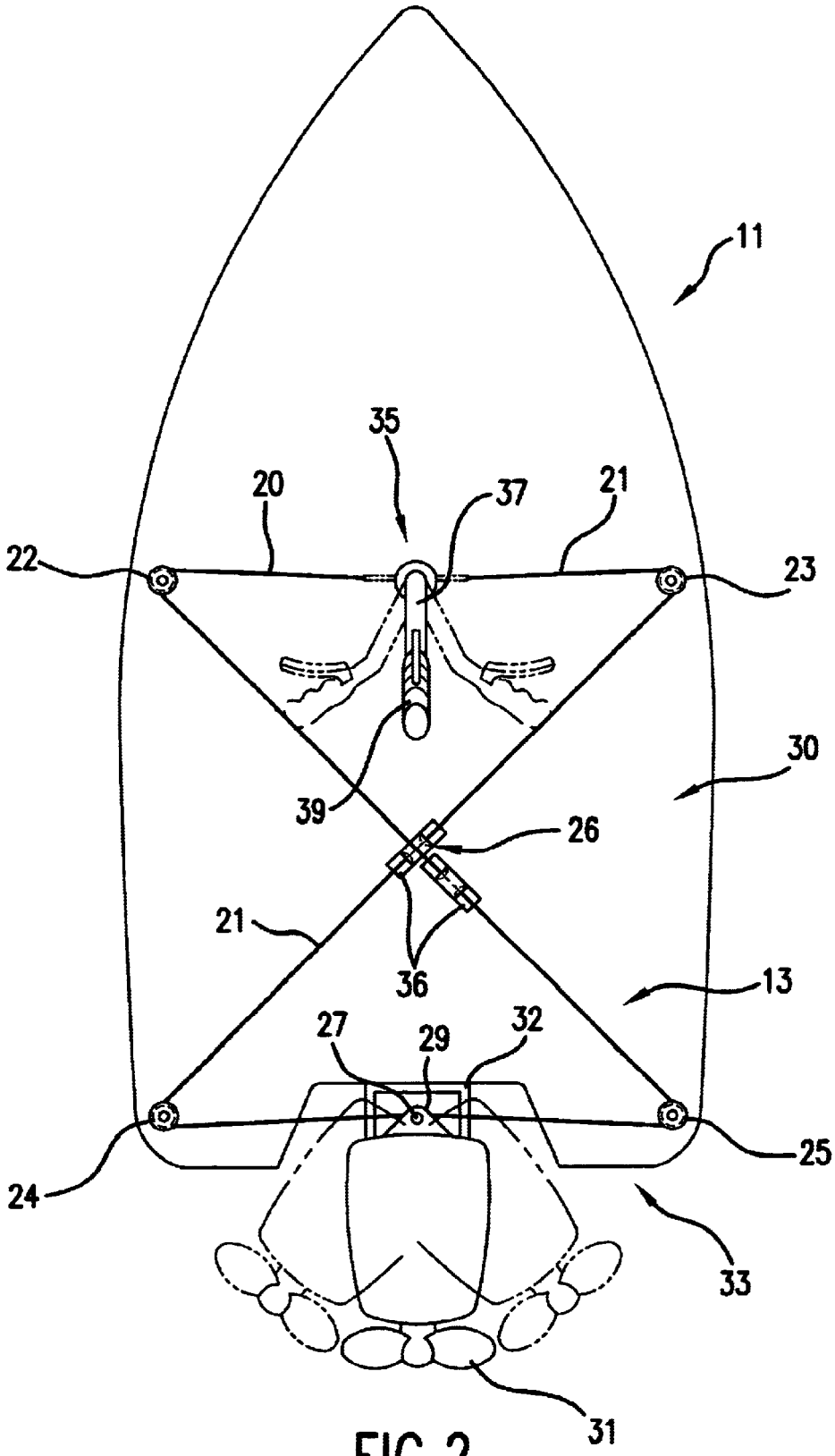
FIG. 2 is a top plan view of an alternate embodiment of a watercraft steering apparatus according to the present invention, showing the joystick and motor in three alternate positions.

Referring to FIG. 1, a steering apparatus, generally referred to as 10, is for use on a small, outboard motor-driven watercraft 11 (see FIG. 2). By "small" is meant a marine vessel less than about 18 feet in length or weighing less than about 800 pounds. The present invention is preferably used in a motor boat between about four and ten feet in length, and weighing less than about 500 pounds, which accommodates one to three people. Suitable watercraft also include dinghies with outboard motors. The watercraft steering apparatus 10 is comprised of a joystick 12, and a pulley system 13. The generally elongate, relatively straight joystick 12 is comprised of a hand grip 14 attached to a top portion of a steering arm 15. A curved trigger-type throttle 16 is attached to the steering arm 15 just below the level of the hand grip 14. The hand grip 14 may be cushioned or molded to better fit a hand of the watercraft driver. The trigger 16 extends in an upward direction close to the hand grip 14 to facilitate grasping by one or more fingers of the same hand. A lower end portion 17 of the steering arm 15 includes two matching apertures 18 on its opposite longitudinal sides, as shown in FIG. 1.

Continuing with FIG. 1, the pulley system 13 is comprised of a set of four pulleys, or jockey wheels, 22–25 and a loop of cable 21. Opposite ends 20 of the loop of cable 21 are threaded through the apertures 18 and tied off. From the joystick 12, the tensioned cable 21 loops around a front pair 22, 23 of spaced-apart, matching wheel-type pulleys. The cable 21 crosses over itself at the approximate centerpoint 26 of the distance between the four pulleys 22–25. The cable 21 then loops around a rear pair 24, 25 of spaced-apart, matching wheel pulleys. The wheel pulleys 22–25 are preferably positioned on opposite longitudinal sides of the watercraft under the decking. Thus, front and rear pulleys 22 and 24 are attached to a port side of the craft, and front and rear pulleys 23 and 25 are affixed to a starboard side of the craft. The front wheel pulleys 22, 23 are preferably each affixed to the deck via a lever, so that they have more give.

The cable 21 is preferably made of nylon or the like, which has been found to produce minimal (or no) vibration. Optionally, the cable may be fixed to the steering arm at a point above the first axis, in which case the cable is looped from the first pair of pulleys to the second pair of pulleys without a crossover in the cable.

The watercraft's outboard motor 28, is hingeably mounted at the center of a stem of the watercraft. The motor 28 pivots about axis M. The tensioned loop of cable 21 is connected to or through an aperture 27 in a coupling hinge 29 projecting from the front of the motor 28. The coupling hinge 29 on the motor 28 allows for adjustment of tension on the cable 21. The rear pair of wheel pulleys 24, 25 are located symmetrically on either side of the motor 28 and are bolted to the boat. The front wheel pulleys 22, 23 are positioned symmetrically on either side of the joystick 12 in front of the rear pair of pulleys under the hull. The front pair of wheel pulleys 22, 23 are fixed to the hull of the watercraft. The pulleys are each free to pivot about axes C, D, E, F, respectively.

During operation of the watercraft, the remote, one-dimensional joystick 12 provides effective steering control. As the steering arm 15 is rotated about axis S, the steering cable 21 rotates the motor 28 to effect steering. Preferably the trigger-type throttle control 16 for the outboard motor 28 is mounted as illustrated in FIG. 1, to allow simultaneous manual operation of throttle and steering. The steering arm 15 is pivoted about axis S, which is fixed relative to the hull of the watercraft. The axis S lies in a vertical plane parallel to a central longitudinal plane of the watercraft, such that operation of the steering arm 15 is generally intuitive. For example, rotation of the steering arm 15 about axis S in the direction A, produces rotation of the motor 28 about the axis M in the direction B (see FIG. 1). Preferably, both the axes M and S lie in the central longitudinal plane of the watercraft, although it will be appreciated that the steering axis S may be displaced to either side of the central longitudinal plane of the craft. Thus, rotation of the joystick 12 towards the left turns the watercraft to the left and rotation of the joystick 12 to the right turns the watercraft to the right.

The steering apparatus 10 allows steering through the full angular steering range of an outboard motor 28, and provides a high steering rate, making the craft very responsive to the steering input. This steering apparatus 10 is particularly applicable to the small high performance, personal type watercraft which are becoming increasingly popular.

Although an outboard motor 28 is illustrated in the preferred embodiment of FIG. 1, the steering apparatus 10 may equally be used to control a stern drive or rudder (not shown). In a second preferred embodiment (not shown), the cable 21 is not crossed over between the front pair of wheel pulleys 22, 23 and the rear pair of wheel pulleys 24, 25. To retain the intuitive operation of the steering, the axis S is moved down the steering arm 15 to a point below the point of attachment of the cable 21.

In the present invention, replacement of the cable 21 is readily achieved. After first gaining access to the hull of the watercraft, the cable 21 may be released from the motor 28 at coupling hinge 29 and from the steering arm 15. Although very little maintenance is required, the cable 21 can easily be accessed, for example, through porthole covers under the seats.

Turning to an alternate embodiment 30 of the steering apparatus, which is depicted in FIG. 2, the watercraft's outboard motor 28 has a conventional propeller 31 at its lower end. The motor 28 is movably mounted by a motor bracket 32 to a stern 33 of the watercraft. A shaft of the motor is rotatable about axis M. The propeller axis is generally horizontal and disposed perpendicular to the longitudinal axis of the watercraft 11.

The steering apparatus 30 includes a crossover pulley system 34 and a joystick 35. The pulley system 34 includes four wheel-type pulleys, and a cable 21, which is connected through an aperture 27 in the coupling hinge 29 on the front of the motor 28. A connection mechanism within the coupling hinge 29 allows for tightening or loosening the tension on the cable 21. The connection mechanism also allows for adjustment of the attachment position of the cable 21. From the coupling hinge 29, the cable 21 loops around the rear pair of matching wheel pulleys 22, 23 located symmetrically on either side of the motor 28 and slightly to the rear of the coupling hinge 29. The cable 21 strands cross over at the centerpoint 26 between the four pulleys 22–25. Guide means 36 are provided to prevent interference between the strands of the cable 21 at the point 26 where they cross. The cable 21 loops around the front pair of pulleys 24, 25 and the cable ends 20 are tied to the bottom of a curved steering arm 37.

Figure 3:
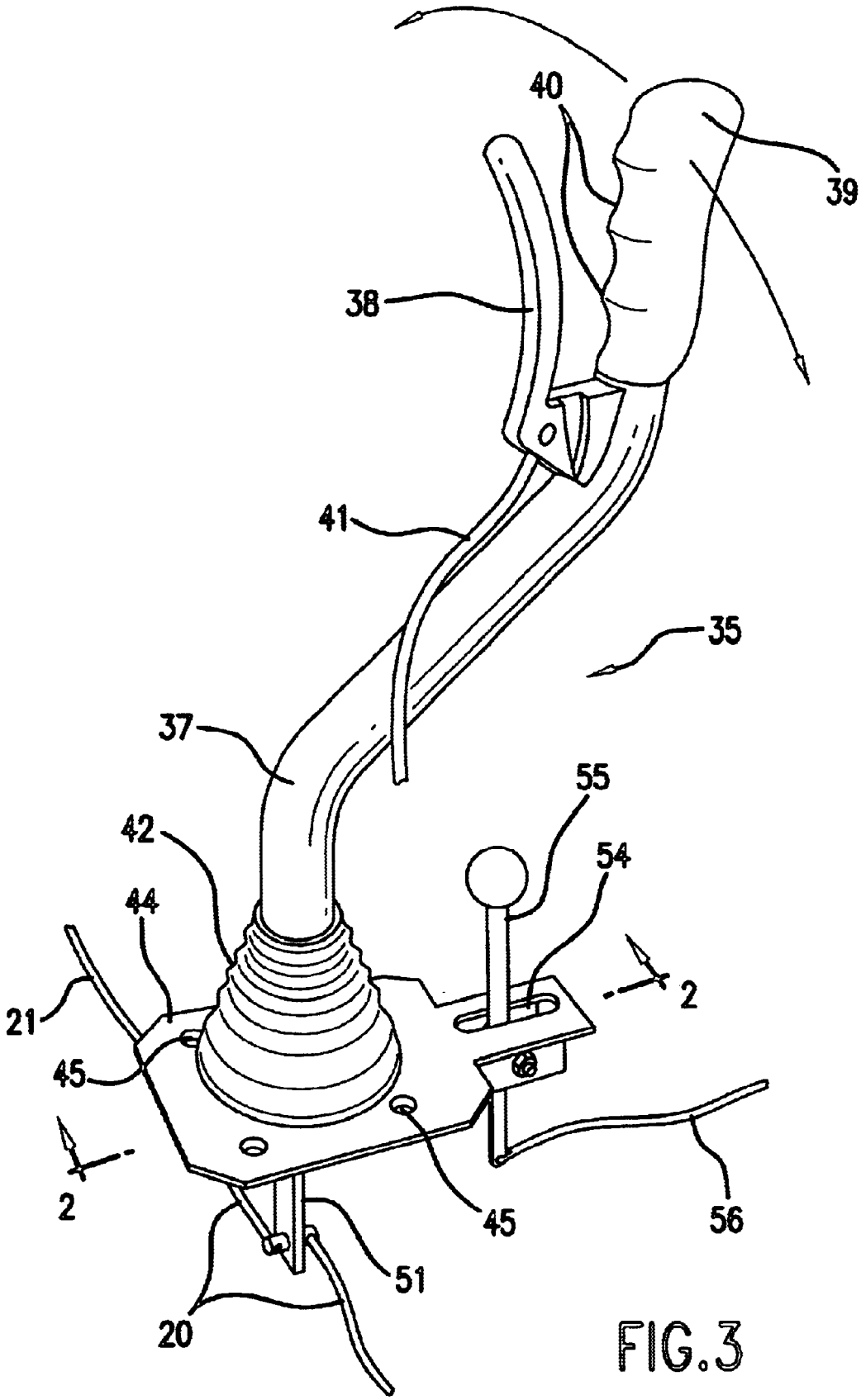
FIG. 3 is a perspective view of a joystick of a steering apparatus according to the present invention.

Referring to FIGS. 2 and 3, the joystick 35 is comprised of a generally elongate, throttle trigger 38, a base of which attaches to the curved steering arm 37 just below the configured hand grip 39. The trigger throttle 38 curves up in a generally vertical direction and away from the hand grip 39. The hand grip 39, which fits over the upper end of the steering arm, has indentations 40 at its front to fit the fingers of a boat driver's hand clenched around the hand grip (not shown). The driver's forefinger can be extended to grasp the adjacent trigger throttle 38 when desired. An accelerator cable 41, which is connected to the throttle mechanism, is connected to the throttle trigger 38 at its base. The curved steering arm 37 extends up from the floor of the boat next to the driver's seat at approximately the longitudinal midline of the craft. The steering arm extends upwardly in a generally vertical direction so that the hand grip 39 of the joystick 35 is easily accessible to the seated driver. The cylindrical steering arm 37 is curved in a generally rearward direction so that the boat driver does not have to stretch to reach the joystick 35.

Figure 4:
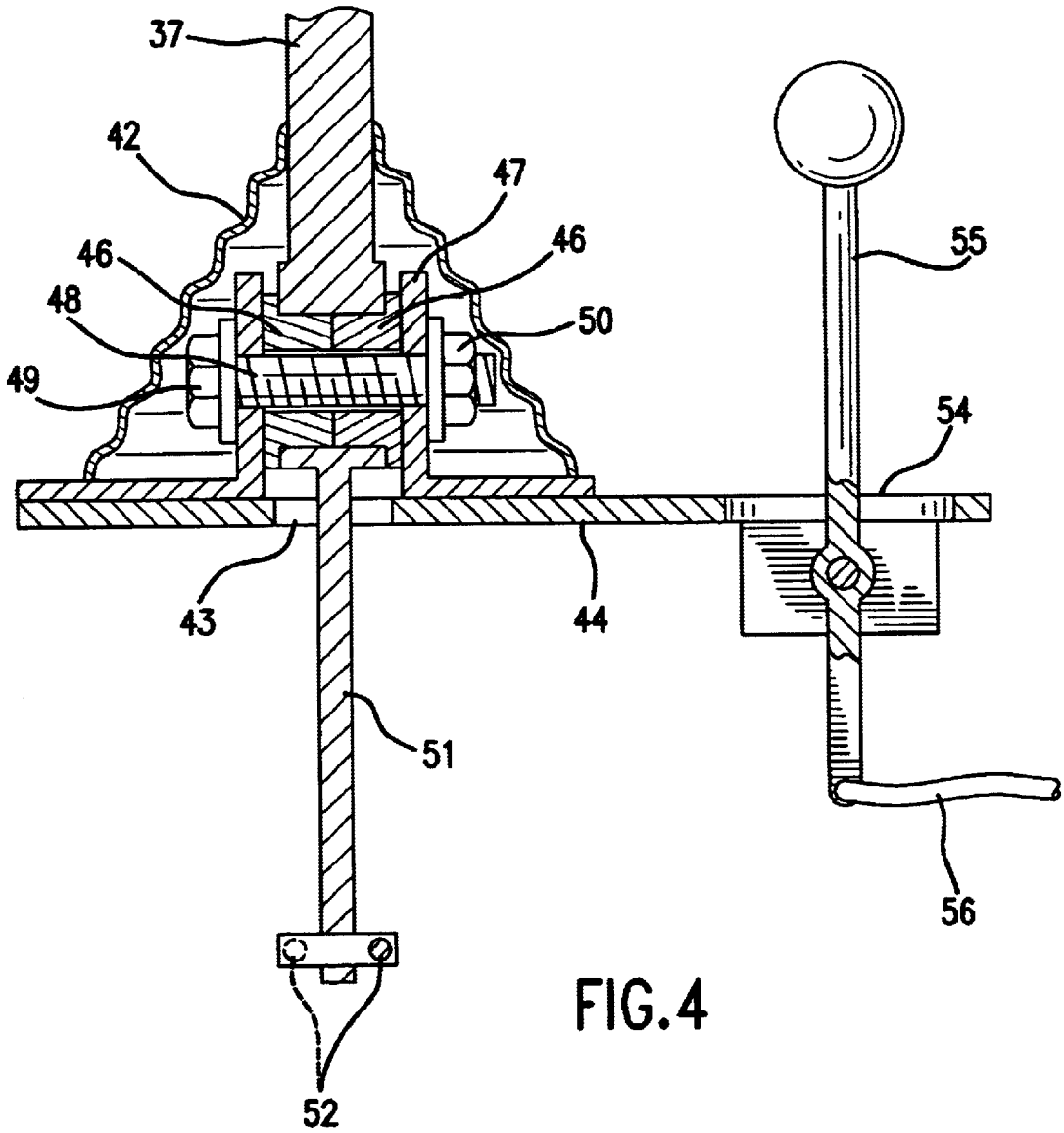
FIG. 4 is a side cross-sectional view of a portion of the joystick and steering apparatus according to FIG. 3, taken along line 4—4.

As shown in FIGS. 3 and 4, the steering arm 37 extends through a rubber boot 42, and through a first aperture 43 in a housing plate 44. The housing plate 44, which is preferably made of stainless steel, is bolted to the boat deck by any suitable means, preferably by bolts (not shown) inserted through bolt apertures 45 in the housing plate.

Looking into the rubber boot 42 of FIG. 3, as seen in the FIG. 4 cross-section, the generally vertical steering arm is cushioned by two bushings 46, which are preferably made of brass or the like. A housing 47, which is preferably made of stainless steel, holds the bushings 46. A bolt 48 extends in a generally horizontal direction through the stainless steel housing 47, with the bolt head 49 shown at the left of FIG. 4. A nut 50 shown at the right of FIG. 4 affixes bolt 48. (The housing bolt 48 holds the steering arm on.) A base 51 of the steering arm extends down in a generally vertical direction below the housing plate 44. The ends 20 of the steering cable 21 are attached to the end portion of the steering arm base 51 by threading them through base apertures 52 (see FIGS. 3 and 4).

Alternatively, a push-pull cable can be attached to the steering arm instead of a steering cable 21. This steering apparatus would be similar in appearance to the steering apparatus shown in FIG. 2.

Simply put, when the joystick 35 is pushed to the driver's right (away from the driver and toward any passenger), the cable 21 pulls the motor 28 to the left and the boat turns starboard; when the joystick 35 is pulled to the driver's left (toward the driver), the motor 28 is pulled to the right and the boat turns to port (see FIG. 2 and direction arrows in FIG. 3). As shown in FIG. 2, the motor 28 is preferably moved approximately 30 degrees to the right or left when the joystick is moved all the way to the right or left. With this simple steering apparatus 30, which is not hydraulic and does not require electricity, the small one or two person watercraft 11 is very responsive to the commands of the driver. Having the throttle trigger 38 adjacent to the hand grip 39 allows for one-handed operation of the watercraft. The present steering apparatus 30 is quite easy for a layman to operate, since he or she need only squeeze the throttle trigger 38 to the hand grip and move two-directional joystick 35 right or left ("where you point the joystick is where you go"). There is no need to rotate a steering wheel. The present steering apparatus 30 is relatively safe, since it idles when the throttle trigger 38 is released. The boat turns according to the amount the joystick has been moved. More subtle performance enhancements can be introduced by, for example, pushing the joystick 35 and then quickly and forcefully squeezing the throttle trigger 38. This results in a hard, smooth turn of approximately 180 degrees.

As is also shown in FIGS. 3 and 4, a second aperture 54 in the housing plate 44 accommodates a gear shift lever 55, which extends through the gear lever aperture 54 in a generally vertical direction. A gear change cable 56 is connected to the base of the gear shift lever 55. The boat driver changes gears using the gear shift lever 55.

From the foregoing it can be realized that the described device of the present invention may be easily and conveniently utilized as a steering apparatus for a small watercraft. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such areas intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A steering apparatus for a motor-driven watercraft, comprising:

(a) a movable, two-directional joystick in the watercraft, the joystick comprising a steering arm;

(b) a depressible throttle trigger affixed to an upper end portion of the joystick; and (c) a pulley system comprising a steering cable, opposite ends of the steering cable being attached to a lower end of the steering arm, the steering cable extending around a plurality of pulleys affixed to the starboard or port side of the watercraft in matching pairs; a front, matching pair of the plurality of pulleys being pivotably affixed to a hull of the watercraft on either side of the joystick, a rear pair of the plurality of pulleys being affixed to the hull of the watercraft on either side of the motor, which is movably attached to a stern of the watercraft;

wherein depression of the throttle trigger and relatively simultaneous movement of the joystick in a first direction, or in a second direction opposite to the first direction, causes the motor to move a corresponding incremental amount, which causes the watercraft to turn in the direction of the movement.

2. A steering apparatus according to claim 1, wherein the steering cable passes through a coupling means on the watercraft motor.

3. A steering apparatus according to claim 2, wherein the steering arm extends through a first aperture in a housing plate, the housing plate being affixed to a deck of the watercraft.

4. A steering apparatus according to claim 3, wherein a base of the steering arm extends in a generally vertical direction from the generally horizontal housing plate, the ends of the steering cable being attached to cable apertures in an end portion of the steering arm base.

5. A steering apparatus according to claim 3, wherein the steering arm is generally vertical and elongate, and is movably affixed to the watercraft by means of a bolt, which extends in a generally horizontal direction through an aperture in the steering arm.

6. A steering apparatus according to claim 5, wherein the steering arm bolt is covered by a rubber-type boot, a bottom of which rests on the housing plate.

7. A steering apparatus according to claim 5, wherein movement of the joystick in the first direction pulls a corresponding end of the steering cable attached to the steering arm base, which pulls the motor in the first direction, which causes the watercraft to turn in the first direction.

8. A steering apparatus according to claim 7, further comprising a gear shift lever extending through a gear lever aperture in the housing plate.

9. A steering apparatus according to claim 2, further comprising a connection mechanism in the coupling means for tensioning the steering cable.

10. A steering apparatus according to claim 9, wherein the coupling means is a coupling hinge on a front of the watercraft motor.

11. A steering apparatus according to claim 2, wherein the pulleys are below deck on a hull of the watercraft, the steering cable being accessible through at least one porthole cover under a seat in an aft section of the watercraft.

12. A steering apparatus according to claim 2, wherein the throttle trigger is generally upwardly extending and elongate, a base of the throttle trigger being affixed to a front midline of the steering arm adjacent a hand grip.

13. A steering apparatus according to claim 1, wherein there are two matching pairs of pulleys: the front pair and the rear pair, which are wheel-type pulleys.

14. A steering apparatus according to claim 13, wherein the steering cable crosses over itself at a centerpoint between the two pairs of pulleys.

15. A steering apparatus according to claim 14, wherein the steering cable extends through guide means at the cable crossover point.

* * * * *